US009683818B2

(12) United States Patent
Lemke et al.

(10) Patent No.: US 9,683,818 B2
(45) Date of Patent: Jun. 20, 2017

(54) POLYMER-BASED COMPOSITE CASINGS AND AMMUNITION CONTAINING THE SAME, AND METHODS OF MAKING AND USING THE SAME

(71) Applicant: PolyCase Ammunition, LLC, Savannah, GA (US)

(72) Inventors: Paul Lemke, Savannah, GA (US); Juan Carlos Marin, Ripoll (ES)

(73) Assignee: PolyCase Ammunition, LLC, Savannah, GA (US)

( * ) Notice: Subject to any disclaimer, the term of this patent is extended or adjusted under 35 U.S.C. 154(b) by 261 days.

(21) Appl. No.: 14/367,288

(22) PCT Filed: Dec. 21, 2012

(86) PCT No.: PCT/US2012/071395
§ 371 (c)(1),
(2) Date: Jun. 20, 2014

(87) PCT Pub. No.: WO2013/096848
PCT Pub. Date: Jun. 27, 2013

(65) Prior Publication Data

US 2015/0075400 A1 Mar. 19, 2015

Related U.S. Application Data

(60) Provisional application No. 61/579,476, filed on Dec. 22, 2011.

(51) Int. Cl.
*F42B 5/307* (2006.01)
*F42B 5/285* (2006.01)
*F42B 5/30* (2006.01)
*F42B 33/00* (2006.01)

(52) U.S. Cl.
CPC ..... *F42B 5/285* (2013.01); *F42B 5/30* (2013.01); *F42B 5/307* (2013.01); *F42B 33/001* (2013.01)

(58) Field of Classification Search
CPC ..... F42B 5/285; F42B 5/307; F42B 5/30
USPC ..... 102/466, 467
See application file for complete search history.

(56) References Cited

U.S. PATENT DOCUMENTS

| | | | | |
|---|---|---|---|---|
| 2,654,319 A | | 10/1953 | Roske | |
| 2,862,446 A | | 12/1958 | Ringdal | |
| 3,874,294 A | * | 4/1975 | Hale | F42B 33/001 102/467 |
| 4,147,107 A | | 4/1979 | Ringdal | |
| 4,718,348 A | | 1/1988 | Ferrigno | |
| 4,726,296 A | * | 2/1988 | Leshner | F42B 5/307 102/430 |
| 5,151,555 A | | 9/1992 | Vatsvog | |
| 5,237,930 A | | 8/1993 | Belanger et al. | |
| 5,259,288 A | | 11/1993 | Vatsvog | |

(Continued)

FOREIGN PATENT DOCUMENTS

| | | |
|---|---|---|
| DE | 16742 | 1/1882 |
| WO | 0034732 | 6/2000 |

(Continued)

*Primary Examiner* — Reginald Tillman, Jr.
(74) *Attorney, Agent, or Firm* — Withers & Keys, LLC

(57) ABSTRACT

Polymer-based composite casings and ammunition containing the same are disclosed. Methods of making and using polymer-based composite casings and ammunition containing the same are also disclosed.

23 Claims, 8 Drawing Sheets

(56) References Cited

U.S. PATENT DOCUMENTS

| | | | |
|---|---|---|---|
| 6,845,716 | B2 | 1/2005 | Husseini et al. |
| 7,059,234 | B2 | 6/2006 | Husseini |
| 7,213,519 | B2 | 5/2007 | Wiley |
| 8,561,543 | B2 | 10/2013 | Burrow |
| 8,689,696 | B1 | 4/2014 | Seeman et al. |
| 2007/0261587 | A1 | 11/2007 | Chung |
| 2011/0179965 | A1 | 7/2011 | Mason |
| 2012/0111219 | A1 | 5/2012 | Burrow |
| 2012/0180688 | A1 | 7/2012 | Padgett |
| 2013/0014664 | A1 | 1/2013 | Padgett |
| 2014/0060372 | A1 | 3/2014 | Padgett |
| 2014/0290522 | A1 | 10/2014 | Padgett |

FOREIGN PATENT DOCUMENTS

| | | |
|---|---|---|
| WO | 2007014024 | 2/2007 |
| WO | 2013070250 | 5/2013 |
| WO | 2013096848 | 6/2013 |

* cited by examiner

POLYMER-BASED COMPOSITE CASINGS AND AMMUNITION CONTAINING THE SAME, AND METHODS OF MAKING AND USING THE SAME

This application is a national stage application of International Patent Application Serial No. PCT/US2012/071395 filed on 21 Dec. 2012, which claims the benefit of priority to U.S. Ser. No. 61/579,476 filed on 22 Dec. 2011, the contents of which are incorporated herein by reference.

TECHNICAL FIELD

The present invention relates to polymer-based composite casings and ammunition comprising the same, methods of making polymer-based composite casings and ammunition comprising the same, and methods of using polymer-based composite casings and ammunition comprising the same.

BACKGROUND

Ammunition used in firearms consists of four components: an initiator or primer, a casing, propellant or gunpowder, and a bullet or projectile (also called tip). The casing is a cylinder that acts as a support for the primer, the projectile and the propellant contained within the casing.

Ammunition has typically been formed from metal. The vast majority of current casings are made of "military brass", called brass 70/30. The most widely used metal is brass, plated steel, steel and, in some cases, aluminum.

Attempts have been made to produce useful ammunition form materials other than metal. For example, U.S. Pat. Nos. 2,654,319; 2,862,446; 6,845,716 and 7,213,519 all disclose ammunition having at least one component formed from a polymeric material. However, all of the disclosed non-metal ammunitions have one or more shortcomings that have prevented wide use, if any, in weapons such as rifles and pistols. For example, prior non-metal ammunitions tend to split (i.e., individual components separate from one another) during firing. In other words, prior non-metal ammunitions do not possess an ammunition structure that regularly withstands the forces within the ammunition during firing.

Efforts continue in the development of ammunition casings that (1) provide one or more unique features, (2) are relatively easy to manufacture and use, (3) provide an aesthetically pleasing look for the user and other viewers, (4) are economical to make and use, and (5) provide an ammunition structure that withstands forces within the ammunition during firing.

SUMMARY

The present invention continues the effort to develop ammunition casings by the discovery of polymer-based composite casings that (1) provide one or more unique features (e.g., a reduction in the overall weight compared to metal casings and ammunition), (2) are relatively easy to manufacture and use, (3) provide an aesthetically pleasing look for the user and other viewers, (4) are economical to make and use, and (5) provide an ammunition structure that withstands forces within the ammunition during firing. The present invention is directed to polymer-based composite casings and ammunition as described and shown herein.

The present invention is directed to composite casings comprising a single continuous polymer wrap; and a metal bushing embedded within the single continuous polymer wrap; wherein the single continuous polymer wrap (i) extends a complete length of the composite casing totally embedding the metal bushing therein or (ii) extends to a lowermost horizontally-extending outer side surface of the metal bushing so as to embed all of the metal bushing except for an extraction rim of the metal bushing.

The single continuous polymer wrap has an inner surface profile along a portion of the single continuous polymer wrap that mirrors an outer side surface profile of the metal bushing embedded within the single continuous polymer wrap. Typically, the inner surface profile of the single continuous polymer wrap and the mirror-image outer side surface profile of the metal bushing comprise one or more vertically-extending side surfaces, one or more horizontally-extending side surfaces, and one or more angularly-extending side surfaces.

In some embodiments, the single continuous polymer wrap has (i) a polymer wrap cylindrical shape with (ii) a first polymer wrap end, (iii) a second polymer wrap end opposite the first polymer wrap end, (iv) a polymer wrap outer surface extending along the polymer wrap cylindrical shape from the first polymer wrap end to the second polymer wrap end, and (v) a series of polymer wrap inner surfaces extending along an inner surface of the polymer wrap cylindrical shape from the first polymer wrap end to the second polymer wrap end; and the metal bushing is embedded within the single continuous polymer wrap at the second polymer wrap end and along a lower portion of the series of polymer wrap inner surfaces. In these embodiments, the lower portion of the series of polymer wrap inner surfaces has an inner surface profile that mirrors an outer side surface profile of the metal bushing.

The present invention is further directed to methods of making the disclosed polymer-based composite casings and methods of using the disclosed polymer-based composite casings. In one exemplary embodiment, the method of making a polymer-based composite casing comprises forming a single continuous wrap of polymeric material with a metal bushing positioned along a base end of the single continuous polymer wrap. In desired methods of making the disclosed polymer-based composite casings, the resulting single continuous polymer wrap (i) shapes the composite casing (i.e., an outer surface profile of the composite casing), and (ii) integrates a majority of or all of the metal bushing into the single continuous polymer wrap via an overmolding step. Further, the resulting single continuous polymer wrap desirably isolates the metal bushing from a powder chamber positioned within the single continuous polymer wrap (e.g., a wall of polymeric material from the single continuous polymer wrap surrounds a chimney component of the metal bushing as discussed further below).

In one exemplary embodiment, the method of using a polymer-based composite casing comprises positioning the composite casing in a chamber of a projectile-firing weapon; and firing the weapon.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Figure 1:
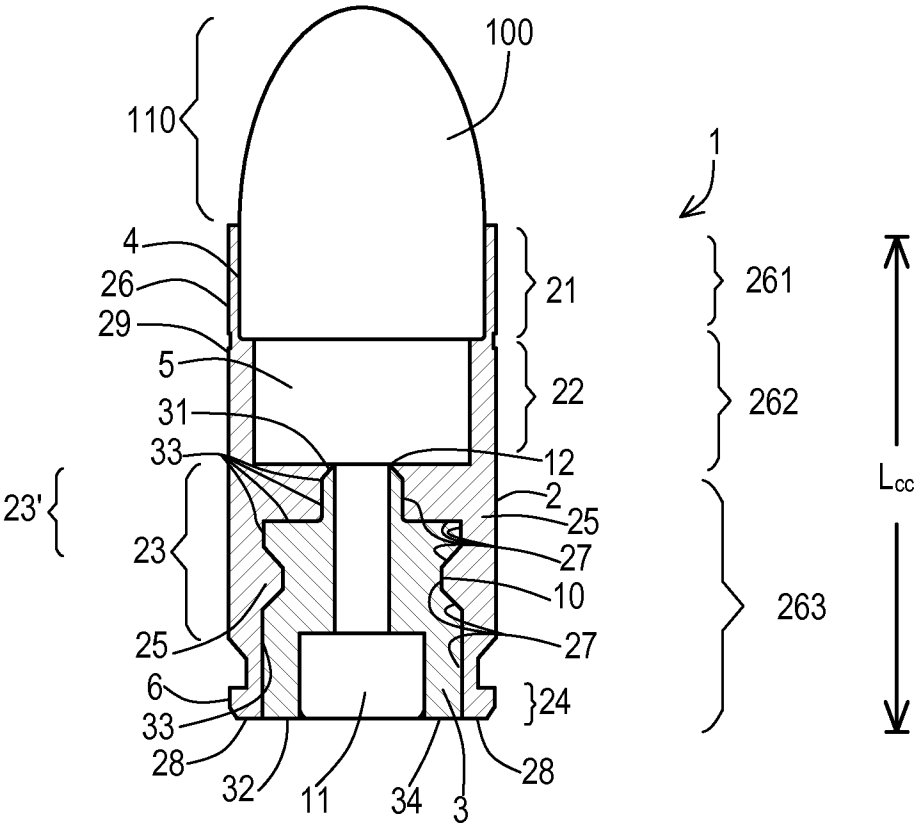
FIG. 1 depicts a cross-sectional view of an exemplary composite casing of the present invention.

The present invention is directed to polymer-based composite casings, methods of making polymer-based composite casings, and methods of using polymer-based composite casings. FIG. 1 provides a cross-sectional view of an exemplary polymer-based composite casing 1 of the present invention.

As shown in FIG. 1, polymer-based composite casing 1 comprises a single continuous polymer wrap such as exemplary single continuous polymer wrap 2 and a metal bushing such as exemplary metal bushing 3. As used herein, the phrase "single continuous polymer wrap" refers to a polymer wrap that comprises a single continuous piece of shaped polymeric material. For example, the single continuous polymer wrap may be formed via a single molding step (e.g., a single injection molding step).

As shown in FIG. 1, exemplary single continuous polymer wrap 2 comprises (i) an overlapping polymer section 21 (shown around a lower portion of projectile 4), (ii) an upper central polymer section 22 that provides and surrounds a powder chamber 5, (iii) a lower central polymer section 23 that encompasses an upper portion of metal bushing 3, and (iv) an end portion 24 that forms an extraction rim 6. As further shown in FIG. 1, exemplary metal bushing 3 may be integrally formed within exemplary single continuous polymer wrap 2 during, for example, an injection molding process (i.e., an overmolding step).

Figure 4:
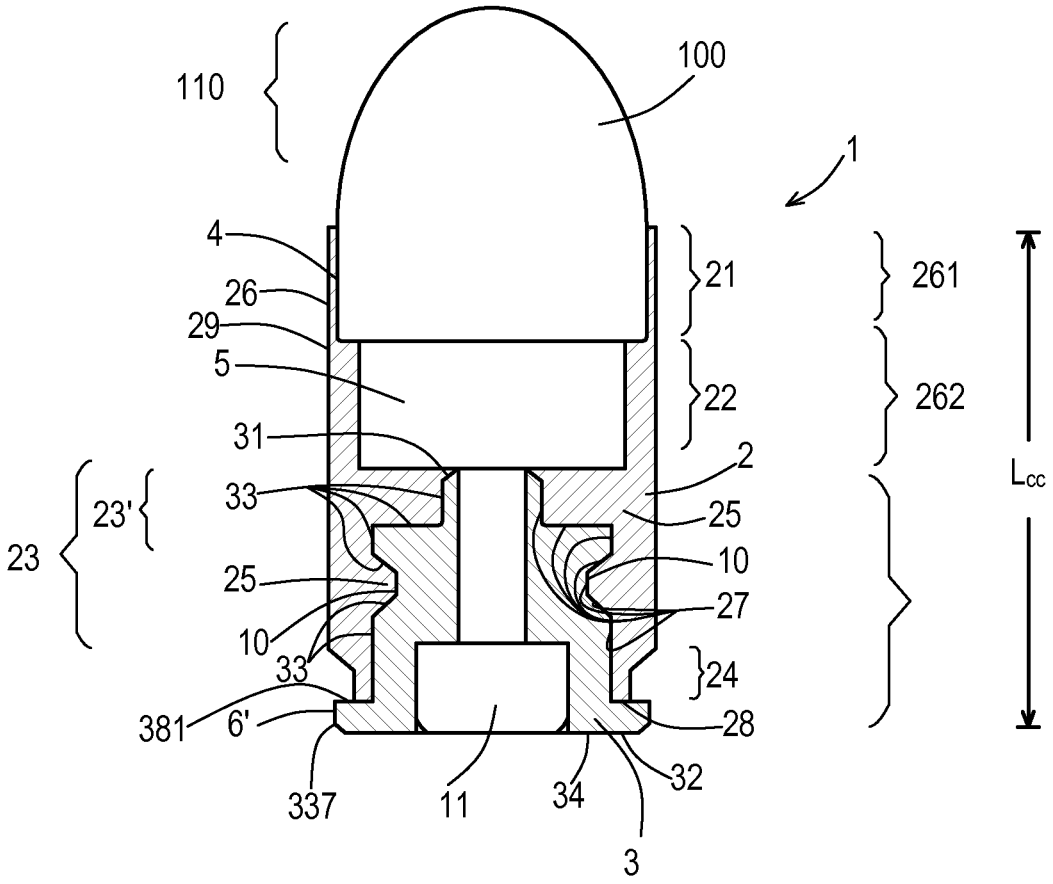
FIG. 4 depicts a cross-sectional view of another exemplary composite casing of the present invention.

FIG. 4 depicts a cross-sectional view of another exemplary composite casing 1 of the present invention. As shown in FIG. 4, exemplary single continuous polymer wrap 2 comprises (i) an overlapping polymer section 21 (shown around a lower portion of projectile 4), (ii) an upper central polymer section 22 that provides and surrounds a powder chamber 5, (iii) a lower central polymer section 23 that encompasses an upper portion of metal bushing 3, and (iv) an end portion 24 that abuts an extraction rim 6' of metal bushing 3. As further shown in FIG. 4, exemplary metal bushing 3 may be integrally formed within exemplary single continuous polymer wrap 2 during, for example, an injection molding process (i.e., an overmolding step).

As further shown in FIGS. 1-2 and 4-5, single continuous polymer wrap 2 has an inner surface profile along inner surfaces 27 of (i) lower central polymer section 23 and (ii) end portion 24 that mirrors outer side surfaces 33 of an outer side surface profile of metal bushing 3 embedded within single continuous polymer wrap 2. As shown in FIGS. 1 and 4, the inner surface profile of single continuous polymer wrap 2 and the mirror-image outer side surface profile of metal bushing 3 along inner surfaces 27 of (i) lower central polymer section 23 and (ii) end portion 24 comprise one or more vertically-extending side surfaces (e.g., a vertically-extending side surface 91 extending along chimney component 9, and three separate vertically-extending side surface components 331, 332 and 333 along a base component 13 of metal bushing 3), one or more horizontally-extending side surfaces (e.g., a horizontally-extending outer surface 38 (i) connecting chimney component 9 to base component 13), and one or more angularly-extending side surfaces (e.g., angularly-extending side surface 92 extending along chimney component 9 and forming sharp edge 12 of metal bushing 3, and two separate angularly-extending side surface components 334 and 335 along base component 13 of metal bushing 3).

Similar to the inner surface profile of single continuous polymer wrap 2 and the mirror-image outer side surface profile of metal bushing 3 of exemplary composite casing 1, typically, other composite casings of the present invention comprise an inner surface profile of a polymer wrap (e.g., single continuous polymer wrap 2) and a mirror-image outer side surface profile of a metal bushing (e.g., metal bushing 3) positioned within the polymer wrap, wherein each of (i) the inner surface profile of the polymer wrap and (ii) the mirror-image outer side surface profile of a metal bushing comprises (1) one or more vertically-extending side surfaces (desirably, at least one vertically-extending side surface, more desirably, at least two vertically-extending side surfaces, and even more desirably, at least three vertically-extending side surfaces), (2) one or more horizontally-extending side surfaces (desirably, at least one horizontally extending side surface, and in some cases, two or more horizontally-extending side surfaces), and (3) one or more angularly-extending side surfaces (desirably, at least one angularly-extending side surface, more desirably, at least two angularly-extending side surfaces, and in some cases, three or more angularly-extending side surfaces, e.g., when two or more notches 10 are present within outer side surfaces 33 of metal bushing 3).

Figure 2:
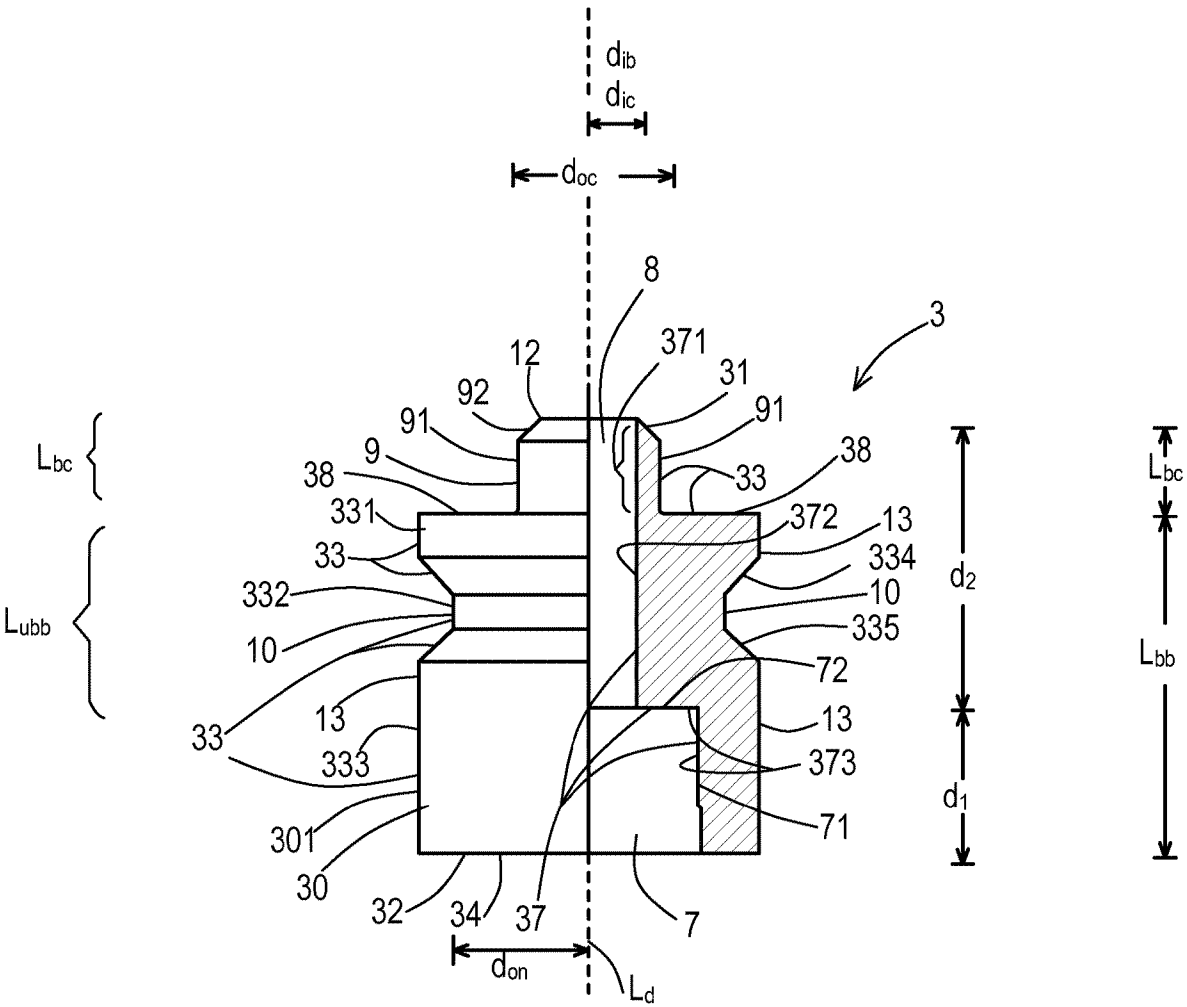
FIG. 2 depicts a cross-sectional view of an exemplary metal bushing suitable for use in the exemplary composite casing of FIG. 1.
Figure 5:
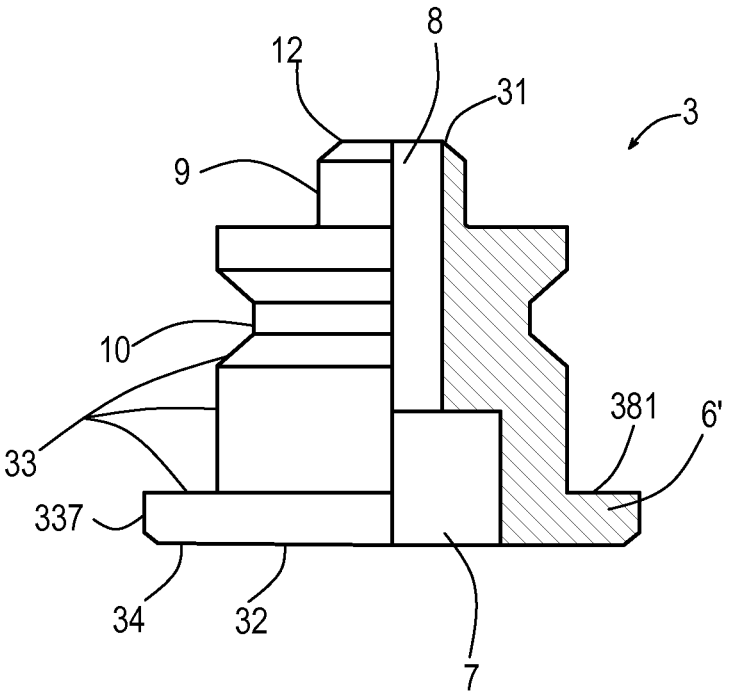
FIG. 5 depicts a cross-sectional view of an exemplary metal bushing suitable for use in the exemplary composite casing of FIG. 4.

As shown in FIGS. 1-2 and 4-5, exemplary metal bushing 3 has a cylindrical metal bushing shape that may be formed, for example, via a lathe, a stamping process, die casting or other metal molding technologies. Referring to FIGS. 2 and 5, exemplary metal bushing 3 comprises (i) a first busing end 31, (ii) a second bushing end 32 opposite first bushing end 31, (iii) an outer bushing side surface 33 extending from first busing end 31 to second bushing end 32, (iv) a primer housing section 7 extending a distance $d_1$ from second busing end 32 towards first bushing end 31 and being bound by primer housing section side wall(s) 71 and primer housing section upper wall(s) 72, (v) a bushing channel 8 that connects primer housing section 7 with powder chamber 5 (see, FIGS. 1 and 4) and extends a distance $d_2$ along exemplary metal bushing 3, wherein $d_1+d_2$ equals an overall length of exemplary metal bushing 3, (vi) a reduction in outer diameter that forms a bushing chimney 9 around an upper portion of bushing channel 8, and (vii) clamping notches 10 along outer bushing side surface 33 of exemplary metal bushing 3.

As shown in FIGS. 1 and 4, clamping notches 10 are filled with polymeric material 25 during injection molding of single continuous polymeric wrap 2 so as to ensure axial positioning of exemplary metal bushing 3 within exemplary single continuous polymeric wrap 2. First bushing end 31 of exemplary metal bushing 3 desirably comprises a sharp edge 12 above bushing chimney 8 so as to (1) minimize the direct action of shooting pressure on exemplary metal bushing 3 and (2) absorb easily machining tolerances of the total length of metal bushing 3 in the mold.

The composite casings of the present invention may comprise (or consist essentially of, or consist of) one or more of the following possible features:

- a polymer wrap outer surface 26 of single continuous polymer wrap 2 that extends a complete length, $L_{cc}$, of composite casing 1 totally embedding metal bushing 3 therein (see, FIG. 1);
- a polymer wrap outer surface 26 of single continuous polymer wrap 2 that extends to a lowermost horizontally-extending outer side surface 381 of metal bushing 3 so as to embed all of metal bushing 3 except for extraction rim 6' of metal bushing 3 (see, FIG. 4);
- a polymer wrap outer surface 26 of single continuous polymer wrap 2 that extends below at least a portion of primer housing 11 positioned (i) within metal bushing 3 (see, FIGS. 1 and 4);
- side surfaces 33 of metal bushing 3 adjoin inner side surfaces 273 of polymer wrap 2 (see, FIG. 1);
- an end surface 34 of metal bushing 3 is exposed along one end of composite casing 1 (see, FIGS. 1 and 4);
- an end surface 34 of metal bushing 3 and an end surface 28 of single continuous polymer wrap 2 form at least a portion of an end surface of composite casing 1 (see, FIG. 1);
- polymer wrap 2 has (i) a polymer wrap cylindrical shape 29 (see, FIGS. 1, 3-4 and 6) with (ii) a first polymer wrap end 290, (iii) a second polymer wrap end 291 opposite first polymer wrap end 290, (iv) a polymer wrap outer surface 26 extending along polymer wrap cylindrical shape 29 from first polymer wrap end 290 to second polymer wrap end 291, and (v) a series of polymer wrap inner surfaces 271, 272 and 273 extending along an inner surface 27 of polymer wrap cylindrical shape 29 from first polymer wrap end 290 to second polymer wrap end 291;
- metal bushing 3 is embedded within polymer wrap 2 at second polymer wrap end 291 and along a lowermost inner surfaces 273 of the series of polymer wrap inner surfaces 271, 272 and 273;
- metal bushing 3 has (i) a metal bushing cylindrical shape 30 with (ii) a first metal bushing end 31, (iii) a second metal bushing end 32 opposite first metal bushing end 31, (iv) a metal bushing outer surface 33 extending along metal bushing cylindrical shape 30 from first metal bushing end 31 to second metal bushing wrap end 32, and (v) a series of metal bushing inner surfaces 371, 372 and 373 extending along an inner surface 37 of metal bushing cylindrical shape 30 from first metal bushing end 31 to second metal bushing end 32;
- metal bushing 3 comprises a chimney component 9 and a base component 13, wherein chimney component 9 extends from first metal bushing end 31 towards second metal bushing end 32 opposite first metal bushing end 31, and has a chimney component outer diameter, $d_{oc}$ (i.e., all diameters being measured from dissecting dashed line $L_d$ shown in FIG. 2), and base component 13 extends from chimney component 9 to second metal bushing end 32, and has a base component outer diameter, $d_{ob}$, wherein base component outer diameter $d_{ob}$ is greater than chimney component outer diameter $d_{cb}$;
- chimney component 9 has a cylindrical shape with a substantially constant chimney component outer diameter $d_{oc}$ along a length, $L_{bc}$, of chimney component 9;
- chimney component 9 has a cylindrical shape with a substantially constant chimney component inner diameter $d_{ic}$ along length $L_{bc}$ of chimney component 9;
- base component 13 has a cylindrical shape with a substantially constant base component inner diameter, $d_{ib}$, along an upper length, $L_{ubb}$, of base component 13;
- base component 13 has a cylindrical shape with a base component outer diameter, $d_{ob}$, that changes along a length, $L_{bb}$, of base component 13;
- base component 13 has at least one notch 10 within base component outer surface 33, and each notch 10 has a notch outer diameter, $d_{on}$, that is less than base component outer diameter $d_{ob}$ and greater than a substantially constant base component inner diameter $d_{ib}$ (e.g., a smallest notch outer diameter, $d_{son}$, is less than a largest base component outer diameter $d_{lob}$ and greater than a substantially constant base component inner diameter $d_{ib}$ along upper length $L_{ubb}$ of base component 13);
- metal bushing 3 has a horizontal outer surface 38 (i) connecting chimney component 9 to base component 13, (ii) positioned along metal bushing outer surface 33, and (iii) being substantially perpendicular to a chimney component outer surface 91 and base component outer surface 301;
- metal bushing 3 has a sharp edge 12 along metal bushing inner surface 37 at first metal bushing end 31;
- series of metal bushing inner surfaces 371, 372 and 373 comprises (i) a chimney portion inner surface 371, (ii) an intermediate channel portion inner surface 372 (i.e., the inner surface extending from chimney 9 to primer housing volume 7), and (iii) an inner surface 373 of a primer housing volume 7 positioned within metal bushing 3;
- primer housing volume 7 of metal bushing 3 comprises (i) a horizontal inner surface component 373' and a vertical inner surface component 373";
- series of polymer wrap inner surfaces 27 comprises (i) a projectile section inner surface portion 271, (ii) a powder chamber inner surface portion 272, and (iii) a metal bushing-mirroring inner surface portion 273;
- metal bushing-mirroring inner surface portions 273 of single continuous polymer wrap 2 extending along outer metal bushing surface 33 of metal bushing 3;
- single continuous polymer wrap 2 comprises an external rim 6 (i.e., extraction rim) along outer surface 26 of single continuous polymer wrap 2; and
- polymeric material 25 of single continuous polymer wrap 2 comprises (or consists essentially of, or consists of) one or more polymers selected from polyamides (PA), polyphthalamides (PPA) and polyether ether ketones (PEEK), which may be unreinforced or reinforced (e.g., with fibers, fillers, or both).

Any of the above-described composite casings 1 comprising (or consisting essentially of, or consisting of) one or more of the above-mentioned features may further comprise one or more of the following components and/or features:

- a primer housing 11 positioned (i) within metal bushing 3 and (ii) along one end 101 of composite casing 1;
- powder (e.g., gun powder)(or alternatively, a propellant) (not shown) within powder chamber 5 of polymer wrap 2;
- a projectile 100, projectile 100 being positioned within polymer wrap 2 such that a tip portion 110 of projectile 100 extends out of first end 290 of polymer wrap 2;
- polymeric material 25 of single continuous polymer wrap 2 filling substantially all voids between (i) outer side surfaces 33 of metal bushing 3 and (ii) outer surface portion 263 of single continuous polymer wrap 2 (i.e., extending along lower central polymer section 23 that encompasses metal bushing 3, and end portion 24 that forms extraction rim 6); and
- polymeric material 25 of single continuous polymer wrap 2 filling substantially all voids between (1)(i) projectile 100 positioned within single continuous polymer wrap 2 and (ii) an outer surface portion 261 of single continuous polymer wrap 2 (i.e., extending along overlapping polymer section 21), (2)(i) a powder chamber 5 positioned within single continuous polymer wrap 2 and (ii) outer surface portion 262 of single continuous polymer wrap 2 (i.e., extending along upper central polymer section 22), and (3)(i) outer side surfaces 33 of metal bushing 3 and (ii) outer surface portion 263 of polymer wrap 2 (i.e., extending along lower central polymer section 23 that encompasses metal bushing 3, and end portion 24 that forms extraction rim 6).

The present invention is even further directed to a plurality of polymer-based composite casings of the present invention. The present invention is also directed to a box of composite casings of the present invention, the box comprising one or more polymer-based composite casings of the present invention positioned within a cartridge-holding device (e.g., a cartridge-holding device typically used to hold metal ammunition casings), and an outer box sized to contain the cartridge-holding device with one or more composite casings positioned therein.

The present invention is further directed to methods of making method of making any of the herein-disclosed composite casings. In one embodiment, the method of making the composite casing of the present invention comprises overmolding a metal bushing with a single continuous polymer wrap material. The overmolding step may comprise, for example, an injection molding step. In preferred embodiments, exemplary single continuous polymer wrap 2 is (1) manufactured by a thermoplastic injection molding step, and (2) has external dimensions (e.g., an overall length, an overall outer diameter along the length, etc.) specific to different standards for the size of a corresponding metal ammunition (e.g., a 9 mm metal cartridge).

In one desired embodiment, the method of making the composite casing of the present invention comprises positioning a metal bushing within a mold; and injection molding polymeric material into the mold so as to encapsulate all or most outer side surfaces of the metal bushing (i.e., outer side surfaces 33 of metal bushing 3). Desirably, methods of making composite casings of the present invention result in composite casings having an outer and inner surface profile, as discussed above, and similar to the outer and inner surface profile of exemplary composite casings 1 shown in FIGS. 1-8.

Once the composite casing is formed, a casing loading process may proceed as in a conventional process using metal casings. For example, methods of composite casing ammunition of the present invention comprise forming a composite casing as discussed above, followed by one or more of the following steps: incorporating powder (not shown) within powder chamber 5 of single continuous polymer wrap 2, inserting projectile 100 into single continuous polymer wrap 2 (i.e., overlapping polymer section 21 of single continuous polymer wrap 2); and incorporating a primer (not shown) within primer housing volume 7 of metal bushing 3.

The present invention is even further directed to methods of using any of the herein-described polymer-based composite casings. Methods of using any of the polymer-based composite casings of the present invention may include, but are not limited to, one or more of the following steps: positioning a composite casing in a chamber of a projectile-firing weapon; and firing the weapon.

During shooting, a pressure within powder chamber 5 increases. The increased pressure in powder chamber 5 causes a projectile 100 to move forward at a high speed. The reaction force of the pressure increase within powder chamber 5 is contained within single continuous polymer wrap 2 as shown in FIGS. 3 and 6.

Figure 3:
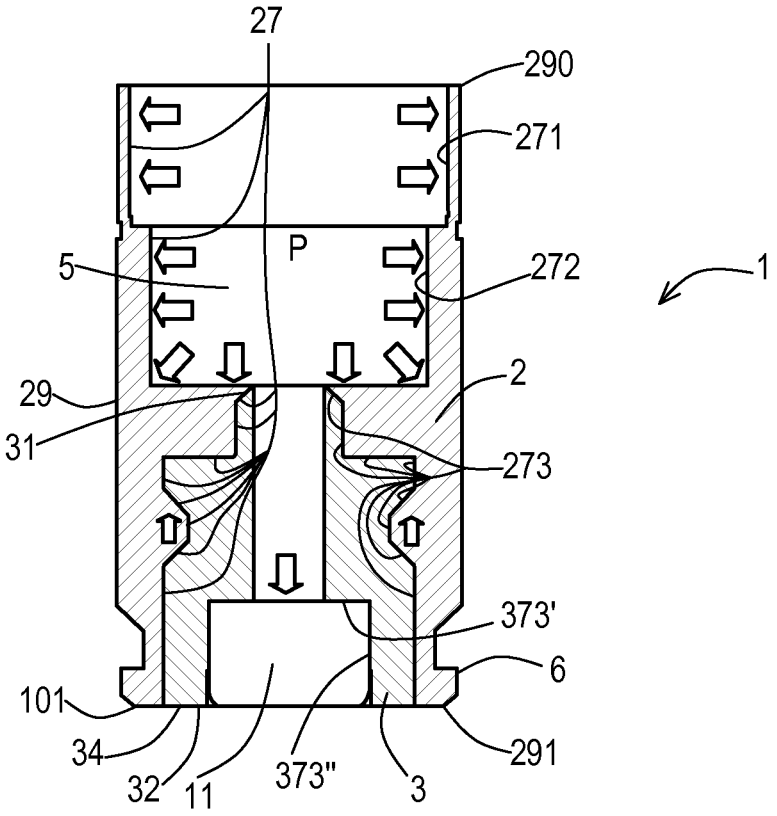
FIG. 3 depicts a cross-sectional view of the effects of pressure on the powder chamber of the exemplary composite casing of FIG. 1 during firing of ammunition comprising the exemplary composite casing of FIG. 1.
Figure 6:
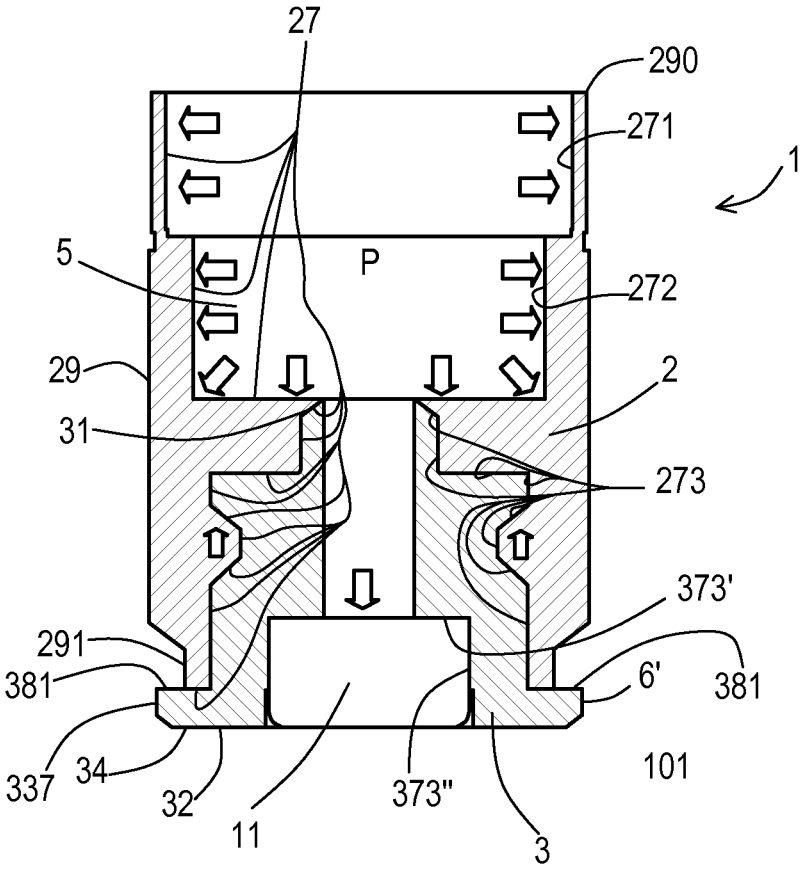
FIG. 6 depicts a cross-sectional view of the effects of pressure on the powder chamber of the exemplary composite casing of FIG. 4 during firing of ammunition comprising the exemplary composite casing of FIG. 4.
Figure 7:
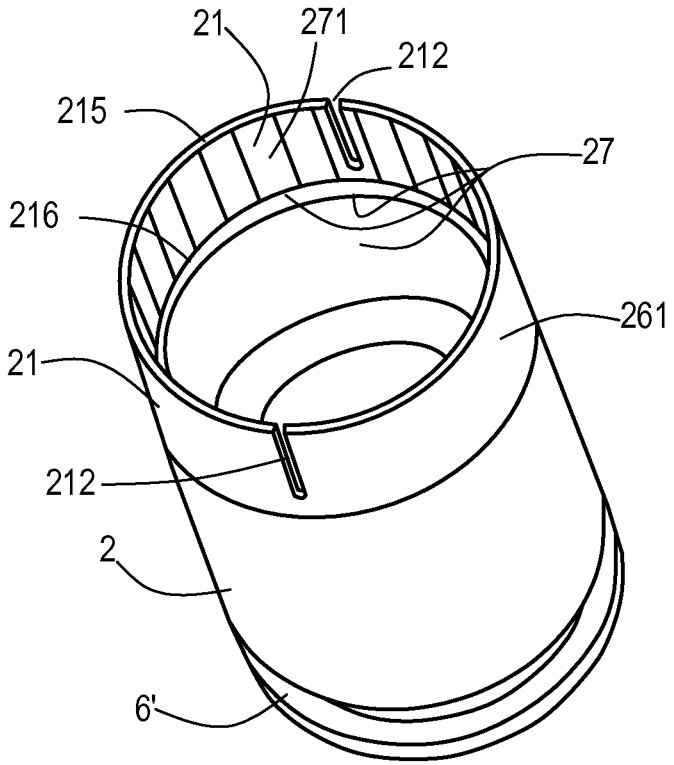
FIG. 7 depicts a top prospective view of an inner surface of an overlapping polymer section of an exemplary single continuous polymer wrap suitable for use in the exemplary composite casings of FIGS. 1 and 4.
Figure 8:
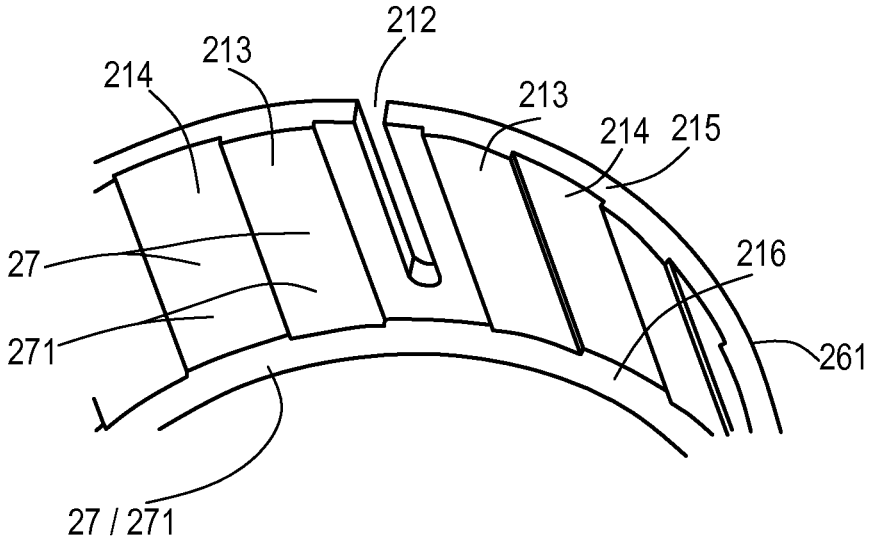
FIG. 8 depicts a close-up view of the inner surface of the overlapping polymer section of the exemplary single continuous polymer wrap shown in FIG. 7.

As shown in FIGS. 3 and 6, radially extending pressure forces pushing on the walls of powder chamber 5 are absorbed by single continuous polymer wrap 2 (e.g., any portion of the single continuous polymer wrap that has an inner surface that contacts powder chamber 5). Axially, the reaction pressure forces do not act directly on metal bushing 3 but are absorbed by a polymeric wall around chimney component 9 (see, polymeric wall portion 23' in FIG. 1) so that, if there is a possibility for metal bushing 3 to move, metal bushing 3 and polymer wrap 2 will move jointly as one part. In addition, notches 10 of metal bushing 3 filled with polymeric material 25 of single continuous polymer wrap 2 further bond metal bushing 3 with single continuous polymer wrap 2 into composite casing 1, which moves as a single part under reaction forces resulting from shooting composite casing 1 within, for example, a gun or pistol (not shown).

Other Embodiments

Composite Casing Embodiments

1. A composite casing 1 comprising: a single continuous polymer wrap 2; and a metal bushing 3 embedded within said single continuous polymer wrap 2; wherein said single continuous polymer wrap 2 (i) extends a complete length $L_{cc}$ of said composite casing 1 totally embedding said metal bushing 3 therein or (ii) extends to a lowermost horizontally-extending outer side surface 381 of said metal bushing 3 so as to embed all of said metal bushing 3 except for an extraction rim 6' of said metal bushing 3.
2. The composite casing 1 of embodiment 1, wherein said single continuous polymer wrap 2 has an inner surface profile 27 that mirrors an outer side surface profile 33 of said metal bushing 3.
3. The composite casing 1 of embodiment 1 or 2, wherein said single continuous polymer wrap 2 has an inner surface profile 27 that mirrors an outer side surface profile 33 of said metal bushing 3, wherein the inner surface profile 27 of said single continuous polymer wrap 2 and the mirror-image outer side surface profile 33 of said metal bushing 3 comprise one or more vertically-extending side surfaces (e.g., vertically-extending side surfaces 331, 332 and 333 of metal bushing 3), one or more horizontally-extending side surfaces (e.g., horizontally-extending side surfaces 38 and 381 of metal bushing 3), and one or more angularly-extending side surfaces (e.g., angularly-extending side surfaces 334 and 335 of metal bushing 3).

4. The composite casing 1 of any one of embodiments 1 to 3, wherein said single continuous polymer wrap 2 has an inner surface profile 27 that mirrors an outer side surface profile 33 of said metal bushing 3, wherein the inner surface profile 27 of said single continuous polymer wrap 2 and the mirror-image outer side surface profile 33 of said metal bushing 3 comprise (1)(i) a vertically-extending side surface 91 extending along a chimney component 9 of said metal bushing 3, and (ii) three separate vertically-extending side surface components 331, 332 and 333 along a base component 13 of said metal bushing 3; (2) a horizontally-extending outer surface 38 connecting said chimney component 9 to said base component 13; and (3)(i) an angularly-extending side surface 92 extending along said chimney component 9 and forming a sharp edge 12 along a first end 31 of said metal bushing 3, and (ii) two separate angularly-extending side surface components 334 and 335 along said base component 13 of said metal bushing 3.

5. The composite casing 1 of any one of embodiments 1 to 4, wherein a polymer wrap outer surface 26 of said single continuous polymer wrap 2 extends a complete length $L_{cc}$ of said composite casing 1 totally embedding said metal bushing 3 therein.

6. The composite casing 1 of any one of embodiments 1 to 5, wherein all outer side surfaces 33 of said metal bushing 3 adjoin inner side surfaces 27 of said single continuous polymer wrap 2.

7. The composite casing 1 of any one of embodiments 1 to 6, wherein an end surface 34 of said metal bushing 3 and an end surface 28 of said single continuous polymer wrap 2 form at least a portion of an end surface of said composite casing 1.

8. The composite casing 1 of any one of embodiments 1 to 7, wherein polymeric material 25 of said single continuous polymer wrap 2 fills substantially all voids between outer side surfaces 33 of said metal bushing 3 and (ii) an outer side surface 26 of said single continuous polymer wrap 2.

9. The composite casing 1 of any one of embodiments 1 to 8, wherein polymeric material 25 of said single continuous polymer wrap 2 fills substantially all voids between (1)(i) a projectile 100 positioned within said single continuous polymer wrap 2 and (ii) an outer surface 26 of said single continuous polymer wrap 2, (2)(i) a powder chamber 5 of said single continuous polymer wrap 2 and (ii) said outer surface 26 of said single continuous polymer wrap 2, and (3)(i) outer side surfaces 33 of said metal bushing 3 and (ii) said outer surface 26 of said single continuous polymer wrap 2.

10. The composite casing 1 of any one of embodiments 1 to 4, wherein a polymer wrap outer surface 26 of said single continuous polymer wrap 2 extends to a lowermost horizontally-extending outer side surface 381 of said metal bushing 3 so as to embed all of said metal bushing 3 except for an extraction rim 6' of said metal bushing 3.

11. The composite casing 1 of any one of embodiments 1 to 4 and 10, wherein all outer side surfaces 33 of said metal bushing 3 adjoin inner side surfaces 27 of said single continuous polymer wrap 2 except for outer side surfaces 337/381 of an extraction rim 6' of said metal bushing 3.

12. The composite casing 1 of any one of embodiments 1 to 4 and 10 to 11, wherein an end surface 34 of said metal bushing 3 forms a peripheral portion of an end surface of said composite casing 1.

13. The composite casing 1 of any one of embodiments 1 to 4 and 10 to 12, wherein polymeric material 25 of said single continuous polymer wrap 2 fills substantially all voids between (1)(i) a projectile 100 positioned within said single continuous polymer wrap 2 and (ii) an outer surface 26 of said single continuous polymer wrap 2, (2)(i) a powder chamber 5 of said single continuous polymer wrap 2 and (ii) said outer surface 26 of said single continuous polymer wrap 2, and (3)(i) all outer side surfaces 33 of said metal bushing 3 except for outer side surfaces 337/381 of an extraction rim 6' of said metal bushing 3 and (ii) said outer surface 26 of said single continuous polymer wrap 2.

14. The composite casing 1 of any one of embodiments 1 to 13, wherein an end surface 34 of said metal bushing 3 is exposed along one end of said composite casing 1.

15. The composite casing 1 of any one of embodiments 1 to 14, wherein said single continuous polymer wrap 2 has (i) a polymer wrap cylindrical shape 29 with (ii) a first polymer wrap end 290, (iii) a second polymer wrap end 291 opposite said first polymer wrap end 290, (iv) a polymer wrap outer surface 26 extending along said polymer wrap cylindrical shape 29 from said first polymer wrap end 290 to said second polymer wrap end 291, and (v) a series of polymer wrap inner surfaces 271/272/273 extending along an inner surface 27 of said polymer wrap cylindrical shape 29 from said first polymer wrap end 290 to said second polymer wrap end 291; and said metal bushing 3 is embedded within said single continuous polymer wrap 2 at said second polymer wrap end 291 and along a lowermost inner surface 273 of said series of polymer wrap inner surfaces 271/272/273.

16. The composite casing 1 of any one of embodiments 1 to 15, wherein said metal bushing 3 has (i) a metal bushing cylindrical shape 30 with (ii) a first metal bushing end 31, (iii) a second metal bushing end 32 opposite said first metal bushing end 31, (iv) a metal bushing outer surface 33 extending along said metal bushing cylindrical shape 30 from said first metal bushing end 31 to said second metal bushing end 32, and (v) a series of metal bushing inner surfaces 371/372/373 extending along an inner surface 37 of said metal bushing cylindrical shape 30 from said first metal bushing end 31 to said second metal bushing end 32.

17. The composite casing 1 of any one of embodiments 1 to 16, wherein said metal bushing 3 comprises a chimney component 9 and a base component 13 integrally connected to one another, said chimney component 9 extends from a first metal bushing end 31 towards a second metal bushing end 32 opposite said first metal bushing end 31, and has a chimney component diameter $d_{ic}$; and said base component 13 extends from said chimney component 9 to said second metal bushing end 32, and has a base component diameter $d_{ib}$, said base component diameter $d_{ib}$ being greater than said chimney component diameter $d_{ic}$.

18. The composite casing 1 of any one of embodiments 4 to 17, wherein said chimney component 9 has a cylindrical shape with a substantially constant chimney component outer diameter $d_{oc}$ along a majority of a length $L_{bc}$ of said chimney component 9.

19. The composite casing 1 of any one of embodiments 4 to 18, wherein said chimney component 9 has a cylindrical shape with a substantially constant chimney component inner diameter $d_{ic}$ along a length $L_{bc}$ of said chimney component 9.

20. The composite casing 1 of any one of embodiments 4 to 19, wherein said base component 13 has a cylindrical shape with a substantially constant first base component inner diameter $d_{ib}$ along a first portion (i.e., inner surface 372) of a length (i.e., length $L_{ubb}$) of said base component 13, and a substantially constant second base component inner diameter $d_{ib}$ along a second portion (i.e., part of inner surface 373) of a length of said base component 13.

21. The composite casing 1 of embodiment 20, wherein said first base component inner diameter $d_{ib}$ is substantially equal to said chimney component inner diameter $d_{ic}$, and said second base component inner diameter $d_{ib}$ is greater than said first base component inner diameter $d_{ib}$ (i.e., the inner diameter along inner surface 373 is greater than the inner diameter along inner surface 372).

22. The composite casing 1 of any one of embodiments 4 to 21, wherein said base component 13 has a cylindrical shape with a base component 13 outer diameter that changes along a length of said base component 13.

23. The composite casing 1 of any one of embodiments 4 to 22, wherein said base component 13 has at least one notch 10 within said base component outer surface 33, and each notch 10 has a notch diameter $d_{on}$ that is less than a base component outer diameter and greater than a base component inner diameter $d_{ib}$.

24. The composite casing 1 of any one of embodiments 1 to 23, wherein said metal bushing 3 has a horizontal outer surface 38 (i) connecting a chimney component 9 to a base component 13, (ii) positioned along said metal bushing outer surface 33, and (iii) being substantially perpendicular to a chimney component outer surface 91 and a base component outer surface 331.

25. The composite casing 1 of any one of embodiments 15 to 24, wherein said metal bushing 3 has a sharp edge 12 along said metal bushing inner surface 371 at said first metal bushing end 31.

26. The composite casing 1 of any one of embodiments 16 to 25, wherein said series of metal bushing inner surfaces 371/372/373 comprises (i) a chimney portion inner surface 371, (ii) an intermediate channel portion inner surface 372, and (iii) an inner surface 373 of a primer housing volume 11 positioned within said metal bushing 3.

27. The composite casing 1 of embodiment 26, wherein said inner surface 373 of said primer housing volume 11 comprises (i) a horizontal inner surface component 373' and (ii) a vertical inner surface component 373".

28. The composite casing 1 of any one of embodiments 15 to 27, wherein said series of polymer wrap inner surfaces 271/272/273 comprises (i) a projectile section inner surface portion 271, (ii) a powder chamber inner surface portion 272, and (iii) a metal bushing-mirroring inner surface portion 273, said metal bushing-mirroring inner surface portion 273 extending along an outer metal bushing side surface 33 of said metal bushing 3.

29. The composite casing 1 of embodiment 28, wherein said projectile section inner surface portion 271 comprises (i) a horizontal inner surface component 216, and (ii) a vertical inner surface component 271.

30. The composite casing 1 of embodiment 28 or 29, wherein said powder chamber inner surface portion 272 comprises (i) a horizontal inner surface component 272, and (ii) a vertical inner surface component 272.

31. The composite casing 1 of any one of embodiments 1 to 9 and 14 to 30, wherein said single continuous polymer wrap 2 comprises an extraction rim 6 along an outer surface 26 of said single continuous polymer wrap 2.

32. The composite casing 1 of any one of embodiments 1 to 4 and 10 to 30, wherein said metal bushing 3 comprises an extraction rim 6' along an outer surface 33 of said metal bushing 3.

33. The composite casing 1 of embodiment 32, wherein said lowermost horizontally-extending outer side surface 381 of said metal bushing 3 is an upper surface of said extraction rim 6'.

34. The composite casing 1 of any one of embodiments 1 to 33, further comprising a primer housing 11 positioned (i) within said metal bushing 3 and (ii) along one end of said composite casing 1.

35. The composite casing 1 of any one of embodiments 1 to 34, wherein said single continuous polymer wrap 2 comprises an overlapping polymer section 21 at a first end 290 thereof, said overlapping polymer section 21 having an opening sized to accept a projectile 100 therein.

36. The composite casing 1 of embodiment 35, wherein said overlapping polymer section 21 has (i) an upper rim 215 extending along said opening, and (ii) a vertically-extending inner surface 27 extending along a projectile section inner surface portion 271, said vertically-extending inner surface 27 ending at a horizontally-extending inner surface 216 of said single continuous polymer wrap 2.

37. The composite casing 1 of embodiment 36, wherein said horizontally-extending inner surface 216 acts as a stop for a projectile 100 positioned within said overlapping polymer section 21.

38. The composite casing 1 of embodiment 36 or 37, wherein said vertically-extending inner surface 27 comprises one or more vertically-extending slots 212 therein, each vertically-extending slot 212 extending (i) from an outer surface 26 of said overlapping polymer section 21 to said vertically-extending inner surface 27 and (ii) from said upper rim 215 towards said horizontally-extending inner surface 216.

39. The composite casing 1 of embodiment 38, wherein said vertically-extending inner surface 27 comprises two or more vertically-extending slots 212 therein.

40. The composite casing 1 of embodiment 38 or 39, wherein each vertically-extending slot 212 extends a majority (i.e., greater than 50%) of a length between said upper rim 215 and said horizontally-extending inner surface 216.

41. The composite casing 1 of any one of embodiments 38 to 40, wherein each vertically-extending slot 212 extends a length (e.g., a complete length) between said upper rim 215 and said horizontally-extending inner surface 216.

42. The composite casing 1 of any one of embodiments 36 to 41, wherein said vertically-extending inner surface 27 comprises a surface profile comprising (i) vertically-extending grooves 214 and (ii) vertically-extending strips 213, said vertically-extending strips 213 having a polymer wrap wall thickness greater than said vertically-extending grooves 214.

43. The composite casing 1 of embodiment 42, wherein said vertically-extending grooves 214 and said vertically-extending strips 213 alternate with one another along said vertically-extending inner surface 27.

44. The composite casing 1 of embodiment 42 or 43, wherein an average diameter between opposing vertically-extending grooves 214 is substantially equal to an outer diameter of a projectile 100 positionable within said overlapping polymer section 21.

45. The composite casing 1 of any one of embodiments 42 to 44, wherein an average diameter between opposing vertically-extending strips 213 is less than an outer diameter of a projectile 100 positionable within said overlapping polymer section 21.

46. The composite casing 1 of any one of embodiments 42 to 45, further comprising a sealant (not shown) within at least a portion of said vertically-extending grooves 214. A sealant (not shown), such as a cyanoacrylate, an acrylic resin, etc. may be applied onto polymer wrap inner surface portion 271 before or after bullet/projectile 100 insertion.

47. The composite casing 1 of any one of embodiments 1 to 46, further comprising gun powder (not shown) within a powder chamber 5 of said single continuous polymer wrap 2.

48. The composite casing 1 of any one of embodiments 1 to 47, further comprising a projectile 100, said projectile 100 being positioned within said single continuous polymer wrap 2 such that a tip portion 110 of said projectile 100 extends out of a first end 290 of said single continuous polymer wrap 2.

49. The composite casing 1 of embodiment 48, wherein said projectile 100 comprises a single projectile 100.

50. The composite casing 1 of embodiment 48 or 49, wherein said projectile 100 comprises a single projectile 100 having a caliber ranging from, for example, about 0.30 inches (in) (7.6 mm) to about 0.50 in (12.7 mm).

51. The composite casing 1 of any one of embodiments 1 to 50, wherein polymeric material 25 of said single continuous polymer wrap 2 comprises one or more polymers selected from polyamides (PA), polyphthalamides (PPA) and polyether ether ketones (PEEK).

52. The composite casing 1 of any one of embodiments 1 to 51, wherein polymeric material 25 of said single continuous polymer wrap 2 comprises one or more polymers selected from polyamides (PA), polyphthalamides (PPA) and polyether ether ketones (PEEK), reinforced with (i) glass fibers, (ii) carbon fibers, or (iii) both glass fibers and carbon fibers (not shown).

53. The composite casing 1 of any one of embodiments 1 to 52, wherein polymeric material 25 of said single continuous polymer wrap 2 comprises a polymeric matrix free of any metallic material.

54. The composite casing 1 of any one of embodiments 1 to 51 and 53, wherein said single continuous polymer wrap 2 consists solely of polymeric material 25.

55. A plurality of composite casings 1, wherein each composite casing 1 within said plurality of composite casings 1 comprises the composite casing 1 of any one of embodiments 1 to 54.

56. A box (not shown) of composite casings 1 comprising: one or more composite casings 1 of any one of embodiments 1 to 54; a cartridge-holding device (not shown); and an outer box (not shown) sized to contain said cartridge-holding device with one or more composite casings 1 positioned therein.

Methods of Making Composite Casings:

57. A method of making the composite casing 1 of any one of embodiments 1 to 54, said method comprising: overmolding a metal bushing 3 with a single continuous polymer wrap 2.

58. The method of embodiment 57, wherein said overmolding step comprises an injection molding step.

59. The method of embodiment 57 or 58, wherein said overmolding step comprises: positioning a metal bushing 3 within a mold (not shown); and injection molding polymeric material 25 into the mold so as to encapsulate all outer side surfaces 33 of the metal bushing 3.

60. The method of any one of embodiments 57 to 59, wherein an end surface 28 of the single continuous polymer wrap 2 and an end surface 34 of the metal bushing 3 form an end of the composite casing 1.

61. The method of embodiment 57 or 58, wherein said overmolding step comprises: positioning a metal bushing 3 within a mold; and injection molding polymeric material into the mold so as to encapsulate all outer side surfaces 33 of the metal bushing 3 except for outer side surfaces 337/381 of an extraction rim 6' of the metal bushing 3.

62. The method of any one of embodiments 57 to 61, further comprising: incorporating gun powder (not shown) within a powder chamber 5 of the single continuous polymer wrap 2; inserting a projectile 100 into an open end of the single continuous polymer wrap 2; and incorporating a primer (not shown) within a primer housing volume 11 of the metal bushing 3.

Methods of Using Composite Casings:

63. A method of using the composite casing 1 of any one of embodiments 1 to 54, said method comprising: positioning the composite casing 1 in a chamber of a projectile-firing weapon (not shown); and firing the weapon.

Example 1

Preparation of Composite Casings and Ammunition

Exemplary composite casings and ammunition as shown in FIGS. 1-8 were prepared using the following steps:

(1) metal bushing 3, formed from stainless steel, was positioned within a mold (i.e., via a removable positioned inserted within primer housing 11);

(2) polymer resin 25, such as a polyamide, was injected into the mold to overmold bushing 3;

(3) gun powder was incorporated within powder chamber 5 of the single continuous polymer wrap 2 formed via step (2);

(4) a projectile, such as a 9 mm projectile and other projectiles such as those disclosed in embodiment 50 above, was inserted into first polymer wrap end 290 of the single continuous polymer wrap 2 formed via step (2); and (5) a primer was incorporated within primer housing volume 11 of metal bushing 3.

The above procedure, or a variation thereof, was used to form ammunition suitable for use in a variety of commercially available rifles and pistols.

It should be understood that although the above-described composite casings, ammunition (i.e., a composite casing in combination with a projectile, gun powder (or propellant) and primer (or initiator)) and methods are described as "comprising" one or more components or steps, the above-described composite casings, ammunition and methods may "comprise," "consists of," or "consist essentially of" any of the above-described components, features or steps of the composite casings, ammunition and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a composite casing and/or method that "comprises" a list of elements (e.g., components, features or steps) is not necessarily limited to only those elements (or components or steps), but may include other elements (or components or steps) not expressly listed or inherent to the composite casing and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a composite casing, ammunition and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described composite casing, ammunition and/or methods may comprise, consist essentially of, or consist of any of the herein-described components and features, as shown in the figures with or without any feature(s) not shown in the figures. In other words, in some embodiments, the composite casing, ammunition and/or methods of the present invention do not have any additional features other than those shown in the figures, and such additional features, not shown in the figures, are specifically excluded from the composite casing, ammunition and/or methods. In other embodiments, the composite casing, ammunition and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A composite ammunition casing comprising:

a single continuous polymer wrap; and a metal bushing embedded within said single continuous polymer wrap, said metal bushing comprising a bushing channel that connects a primer housing section of said metal bushing to a powder chamber of said composite casing;

wherein (1) said single continuous polymer wrap (i) extends a complete length of said composite casing totally embedding said metal bushing therein or, (2) said single continuous polymer wrap does not come into contact with said bushing channel, and (3) an end surface of said metal bushing is exposed along one end of said composite casing, and (4) said end surface of said metal bushing and an end surface of said single continuous polymer wrap form at least a portion of an end surface of said composite casing.

2. The composite casing of claim 1, wherein said single continuous polymer wrap has an inner surface profile that mirrors an outer side surface profile of said metal bushing, wherein the inner surface profile of said single continuous polymer wrap and the mirror-image outer side surface profile of said metal bushing comprise one or more vertically-extending side surfaces, one or more horizontally-extending side surfaces, and one or more angularly-extending side surfaces.

3. The composite casing of claim 1, wherein said single continuous polymer wrap has an inner surface profile that mirrors an outer side surface profile of said metal bushing, wherein the inner surface profile of said single continuous polymer wrap and the mirror-image outer side surface profile of said metal bushing comprise (I)(i) a vertically-extending side surface extending along a chimney component of said metal bushing, and (ii) three separate vertically-extending side surface components along a base component of said metal bushing; (2) a horizontally-extending outer surface connecting said chimney component to said base component; and (3)(i) an angularly-extending side surface extending along said chimney component and forming a sharp edge along a first end of said metal bushing, and (ii) two separate angularly-extending side surface components along said base component of said metal bushing.

4. The composite casing of claim 1, wherein said single continuous polymer wrap has (i) a polymer wrap cylindrical shape with (ii) a first polymer wrap end, (iii) a second polymer wrap end opposite said first polymer wrap end, (iv) a polymer wrap outer surface extending along said polymer wrap cylindrical shape from said first polymer wrap end to said second polymer wrap end, and (v) a series of polymer wrap inner surfaces extending along an inner surface of said polymer wrap cylindrical shape from said first polymer wrap end to said second polymer wrap end; and said metal bushing is embedded within said single continuous polymer wrap at said second polymer wrap end and along a lowermost inner surface of said series of polymer wrap inner surfaces.

5. The composite casing of claim 1, wherein said metal bushing has a horizontal outer surface (i) connecting a chimney component to a base component, (ii) positioned along said metal bushing outer surface, and (iii) being substantially perpendicular to a chimney component outer surface and a base component outer surface.

6. The composite casing of claim 1, wherein said metal bushing comprises a series of metal bushing inner surfaces comprising (i) a chimney portion inner surface, (ii) an intermediate channel portion inner surface, and (iii) an inner surface of a primer housing volume positioned within said metal bushing.

7. The composite casing of claim 1, wherein said single continuous polymer wrap comprises a series of polymer wrap inner surfaces comprising (i) a projectile section inner surface portion, (ii) a powder chamber inner surface portion, and (iii) a metal bushing-mirroring inner surface portion, said metal bushing-mirroring inner surface portion extending along an outer metal bushing side surface of said metal bushing.

8. The composite casing of claim 7, wherein said projectile section inner surface portion comprises (i) a horizontal inner surface component and (ii) a vertical inner surface component.

9. A composite ammunition casing comprising:

a single continuous polymer wrap; and a metal bushing embedded within said single continuous polymer wrap, said metal bushing comprising a bushing channel that connects a primer housing section of said metal bushing to a powder chamber of said composite casing:

wherein (1) said single continuous polymer wrap (i) extends a complete length of said composite casing totally embedding said metal bushing therein or, (2) said single continuous polymer wrap does not come into contact with said bushing channel (3) an end surface of said metal bushing is exposed along one end of said composite casing, and (4) said single continuous polymer wrap comprises an extraction rim along an outer surface of said single continuous polymer wrap.

10. The composite casing of claim 1, further comprising a primer housing positioned (i) within said metal bushing and (ii) along one end of said composite casing.

11. A composite ammunition casing comprising:

a single continuous polymer wrap; and a metal bushing embedded within said single continuous polymer wrap, said metal bushing comprising a bushing channel that connects a primer housing section of said metal bushing to a powder chamber of said composite casing:

wherein (1) said single continuous polymer wrap (i) extends a complete length of said composite casing totally embedding said metal bushing therein or, (2) said single continuous polymer wrap does not come into contact with said bushing channel (3) an end surface of said metal bushing is exposed along one end of said composite casing, and (4) said single continuous polymer wrap comprises an overlapping polymer section at a first end thereof, said overlapping polymer section having an opening sized to accept a projectile therein, wherein said overlapping polymer section has (i) an upper rim extending along said opening, and (ii) a vertically-extending inner surface extending along a projectile section inner surface portion, said vertically-extending inner surface ending at a horizontally-extending inner surface of said single continuous polymer wrap.

12. The composite casing of claim 11, wherein said vertically-extending inner surface comprises one or more vertically-extending slots therein, each vertically-extending slot extending (i) from an outer surface of said overlapping polymer section to said vertically-extending inner surface and (ii) from said upper rim towards said horizontally-extending inner surface.

13. The composite casing of claim 11, wherein said vertically-extending inner surface comprises a surface profile comprising (i) vertically-extending grooves and (ii) vertically-extending strips, said vertically-extending strips having a polymer wrap wall thickness greater than said vertically-extending grooves.

14. The composite casing of claim 13, wherein said vertically-extending grooves and said vertically-extending strips alternate with one another along said vertically-extending inner surface.

15. The composite casing of claim 1, further comprising a projectile, said projectile being positioned within said single continuous polymer wrap such that a tip portion of said projectile extends out of a first end of said single continuous polymer wrap.

16. The composite casing of claim 15, wherein said projectile comprises a single projectile having a caliber ranging from about (0.30 inches (in) (7.6 mm) to about 0.50 in (12.7 mm).

17. A method of making the composite casing of claim 1, said method comprising:

overmolding the metal bushing with the single continuous polymer wrap.

18. A method of using the composite casing of claim 1, said method comprising:

positioning the composite casing in a chamber of a projectile-firing weapon; and firing the weapon.

19. The composite casing of claim 9, further comprising a projectile, said projectile being positioned within said single continuous polymer wrap such that a tip portion of said projectile extends out of a first end of said single continuous polymer wrap.

20. A method of using the composite casing of claim 9, said method comprising:

positioning the composite casing in a chamber of a projectile-firing weapon; and firing the weapon.

21. The composite casing of claim 11, further comprising a projectile, said projectile being positioned within said single continuous polymer wrap such that a tip portion of said projectile extends out of a first end of said single continuous polymer wrap.

22. The composite casing of claim 21, wherein said projectile comprises a single projectile having a caliber ranging from about 0.30 inches (in) (7.6 mm) to about 0.50 in (12.7 mm).

23. A method of using the composite casing of claim 11, said method comprising:

positioning the composite casing in a chamber of a projectile-firing weapon; and firing the weapon.

* * * * *